US007479595B2

(12) United States Patent
Shen et al.

(10) Patent No.: US 7,479,595 B2
(45) Date of Patent: Jan. 20, 2009

(54) METHOD AND SYSTEM FOR PROCESSING MUSIC ON A COMPUTER DEVICE

(75) Inventors: Yeh Shen, Los Angeles, CA (US); Hao Zhou, The Gardens at Bishan (SG)

(73) Assignee: Concertizer Enterprises, Inc., Los Angeles, CA (US)

( * ) Notice: Subject to any disclaimer, the term of this patent is extended or adjusted under 35 U.S.C. 154(b) by 395 days.

(21) Appl. No.: 11/431,227

(22) Filed: May 9, 2006

(65) Prior Publication Data

US 2007/0261536 A1 Nov. 15, 2007

(51) Int. Cl.
*G04B 13/00* (2006.01)
*G10H 7/00* (2006.01)

(52) U.S. Cl. ..... 84/609; 84/600; 84/615; 84/649; 84/653

(58) Field of Classification Search ..... None
See application file for complete search history.

(56) References Cited

U.S. PATENT DOCUMENTS 7,202,408 B2 * 4/2007 Fallgatter ..... 84/645
2005/0235812 A1 * 10/2005 Fallgatter ..... 84/645
2006/0011044 A1 * 1/2006 Chew ..... 84/609
2007/0227340 A1 * 10/2007 Fallgatter ..... 84/615
2007/0256546 A1 * 11/2007 Hikino et al. ..... 84/615
2008/0141849 A1 * 6/2008 Johnston ..... 84/483.2
2008/0216639 A1 * 9/2008 Worrall et al. ..... 84/722

* cited by examiner

*Primary Examiner*—Marlon T Fletcher
(74) *Attorney, Agent, or Firm*—Townsend and Townsend and Crew LLP

(57) ABSTRACT

A method for processing and playing music. The method includes providing a computing system, an input device, and a display. The method provides a selected music composition in a sequence of music notes. A user input is provided at a selected time as the selected music composition is animated on the display. The user input is processed by the computing system and output a sound. A timing accuracy of the user input is also being determined. The method can be adapted to any digital apparatus that provides a display, a sound output, a user input device, and a data processing device.

8 Claims, 7 Drawing Sheets

METHOD AND SYSTEM FOR PROCESSING MUSIC ON A COMPUTER DEVICE

CROSS-REFERENCES TO RELATED APPLICATIONS

NOT APPLICABLE

STATEMENT AS TO RIGHTS TO INVENTIONS MADE UNDER FEDERALLY SPONSORED RESEARCH OR DEVELOPMENT

NOT APPLICABLE

REFERENCE TO A "SEQUENCE LISTING," A TABLE, OR A COMPUTER PROGRAM LISTING APPENDIX SUBMITTED ON A COMPACT DISK

NOT APPLICABLE

BACKGROUND OF THE INVENTION

The present invention relates generally to music technique. More particularly, the present invention provides a method and system for processing one or more parts of a music composition using a computing device. Merely by way of example, the invention has been applied to a personal computer. But it would be recognized that the invention can also be applied to a personal digital assistant, a cellular phone, a lap top computer, a networked computer, any combination of these, and the like.

The act of playing a music piece, vocally or on an instrument, has been practiced probably since the beginning of human history. Technical qualities such as accuracy of pitch, timing, and duration of each musical note are critical in play a music composition. Conventionally, to achieve such qualities in playing a music composition includes constant practice and assessment of such qualities relies entirely on another human (e.g., an instructor, audience, etc). Moreover, for a novice music player, learning to read musical notes in addition to learning to play a music composition on an instrument can be a challenge. In addition, in playing a music piece interactively among more than one players, for example, using an interlocking techniques, all the players would have to be in the same room. These and other limitation of playing music and learning to play music will be discussed more fully below.

From the above, it seems that an improved method of playing music or learning to play music is desired.

BRIEF SUMMARY OF THE INVENTION

According to the present invention, techniques related to music are provided. More particularly, the present invention provides a method and system for processing one or more parts of a music composition using a computing device. Merely by way of example, the invention has been applied to a personal computer. But it would be recognized that the invention can also be applied to a personal digital assistant, a cellular phone, a lap top computer, a networked computer, any combination of these, and the like.

In a specific embodiment, the present invention provides a method for processing music compositions. The method includes selecting a music composition in a digital format. The music composition includes a sequence of notes from a selected part of a music piece. The method includes transferring an information representing the music composition, including the sequence of notes to a display device of a computing device. The method then animate the sequence of notes on the display device. The method includes receiving an input from a human user during a selected time as one or more notes are being animated in a sequential order of the music composition on the display device. The method includes processing the input from the human user using the computing device and outputting a sound associated with the one or more notes based upon at least the processing. The sound is associated with the one or more notes in the selected part of the music composition.

In a specific embodiment, the present invention provides a music composition input device. The music composition input device includes a display device. The display device is adapted to output a sequence of notes numbered from 1 through N. The sequence of notes is scrolled from a first portion of the display to a second portion of the display. The music composition input device includes a first key. The first key is selectively actuated to represent a same pitch from a first note to a second note in the sequence of notes. The first note is temporally before the second note. The first note is spatially adjacent to the second note. The music composition input device also includes a second key. The second key is selectively actuated to represent a higher pitch from a third note to a fourth note in the sequence of notes. The third note is provided temporally before the fourth note. The third note is provided spatially adjacent to the fourth note. The music composition input device also includes a third key. The third key is selectively actuated to represent a lower pitch from a fifth note to a sixth note in the sequence of notes. The fifth note is provided temporally before the sixth note and the fifth note is provided adjacent to the sixth note. In a specific embodiment, the first key, the second key, and the third key are provided on a computer keyboard. In an alternative embodiment, the first key, the second key, and the third key are provided on a personal digital assistant keyboard or a cellular phone keyboard. In yet an alternate embodiment, the first key, the second key, and the third key are provided on a game controller keyboard.

In a specific alternative embodiment, the present invention provides a method for playing music compositions. The method includes selecting a music composition in a digital form. The method includes transferring information representing a sequence of musical notes to a display device of a computing device. The sequence of musical notes represents a selected part of the music composition. The method includes scrolling the sequence of notes on the display device. The method includes provides an input, using one of a plurality of keys during a selected time as one or more notes are being scrolled in the sequential order of the music composition on the display device. The method includes playing the one or more notes at the selected time. The method also includes processing the input by the computing device from a human user and outputting a sound associated with the one or more notes based upon at least the processing. The sound is associated with the one or more notes in the selected part of the music composition. The method continues to perform at least the inputting, processing, and outputting to play the selected part of the music composition.

In a specific alternative embodiment, the present invention provides a system for processing music compositions. The system includes one or more memories. The one or more memories include one or more codes directed to receiving a selection of a music composition in digital form. The one or more memories also include one or more codes directed to transferring information representing a sequence of notes to a display device of a computing device. The sequence of notes represents a selected part of the music composition. The one or more memories also include one or more codes directed to scroll the sequence of notes on the display device. The one or more memories include one or more codes directed to receiving input information from an input from a human user during a selected time as one or more notes are being scrolled in the sequential order of the music composition on the display device. The one or more memories also include one or more codes directed to processing the input by the computing device from the human user. The one or more memories also include one or more codes directed to outputting a sound associated with the one or more notes based upon at least the processing. The sound is associated with the one or more notes in the selected part of the music composition.

Many benefits can be achieved by ways of present invention. For example, the present invention provides an easy to use system to process music composition on a personal computer, a personal digital assistant, a laptop computer, a networked computer, or any combination thereof. In addition, the present invention provides a method and system to allow cooperation and competition in a multiple users environment. In some embodiments, the invention allows users to engage interactively with the system. Depending on the embodiments, one or more of the benefits may be achieved. These and other benefits will be described in more throughout the present specification and more particularly below.

Various additional objects, features and advantage of the present invention can be more fully appreciated with reference to the detailed description and accompanying drawings that follow.

DETAILED DESCRIPTION OF THE INVENTION

The playing of a music composition on a musical instrument includes quality such as accuracy of pitch, timing, and duration of each musical notes. As noted, for a novice music player, learning to read musical notes effectively in addition to learning to play an instrument is difficult. Accordingly, embodiments in accordance to present invention provide a method and a system to enable a music player to learn and to play a music composition. Embodiments in accordance to present invention may include displaying musical notes on a display device and provide a simplified method to recognize a pitch change in a musical composition. Additionally, embodiments according to present invention provide visual and audio aids for accurate timing and accurate duration of each notes. For example, embodiments according to the present invention provide means to prompt a user to play a music note during a pre-determined time range and to show a duration a user is to hold each note.

Accordingly, embodiments according to present invention provide techniques related to music. More particularly, the present invention provides a method and system for processing one or more parts of a musical compositions using a computing (digital) device. Merely by way of example, the invention has been applied to a personal compute system. But it would be recognized that the invention can also be applied to a personal digital assistant, a laptop computer, a networked computer, any combination of these and the like.

A method for processing music according to an embodiment of the present invention may be outlined as follow:

1. Provide a musical composition in digital form;
2. Transfer sequence of notes for musical composition to digital display device;
3. Animate sequence of notes;
4. Input one or more notes at selected time by user;
5. Process input
6. Output sound.

The above sequence of steps provide a method according to an embodiment of the present invention. In a specific embodiment, the present invention provides a method for processing a music composition in a digital format. Other alternatives can also be provided where steps are added, one or more steps are removed, or one or more steps are provided in a different sequence without departing for the scope of the claims. Details of the present method can be found throughout the present invention and more particularly below.

Figure 1:
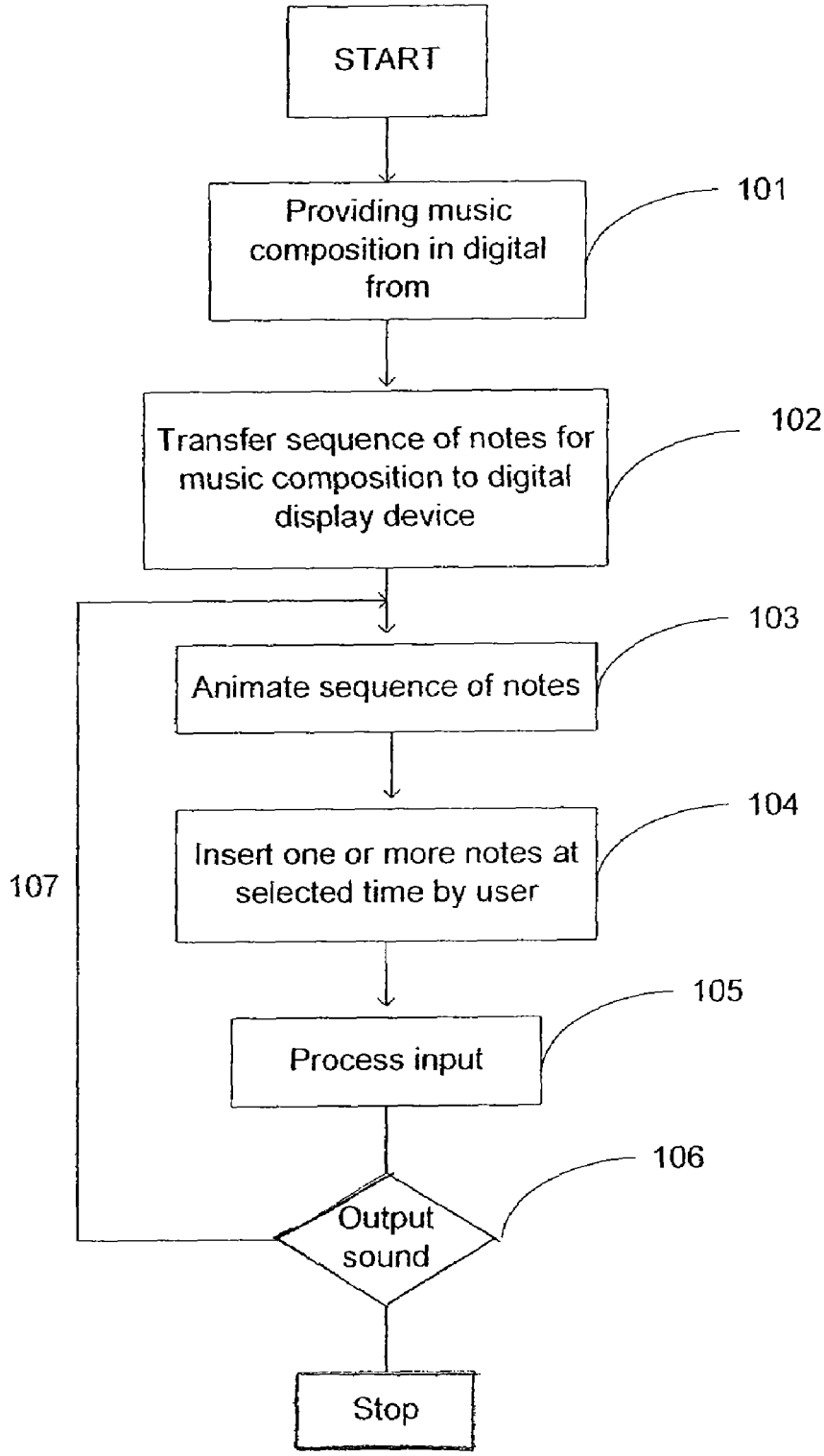
FIG. 1 is a simplified flow diagram illustrating a music method according to an embodiment of the present invention.

FIG. 1 is a simplified flow diagram illustrating a music method according to an embodiment of the present invention. As shown, the method includes a start step. The method includes providing a music composition in digital form (Step 101). The musical composition can be part of a published musical composition, but can be others. The music composition is then transferred to a display device in a sequence of music notes presented on musical staff, including clef (Step 102). The method includes animating the sequence of notes (Step 103) on the display. At a selected time interval, a user inputs one or more notes (Step 104). The method then processes the user input (Step 105) and output (Step 106) a sound. Afterwards, the user can provide another input (Step 107) or the process can end (Step 108).

The above sequence of steps provides a method of processing music according to an embodiment of present invention. In a specific embodiment, the present invention provides a method for processing music using a computing device, an input device and a display device, among others. Other alternatives can also be provided where steps are added, one or more steps are removed, or one or more steps are provided in a different sequence without departing from the scope of the claims herein. Details of the present method can be found throughout the present specification and more particularly below.

Figure 2:
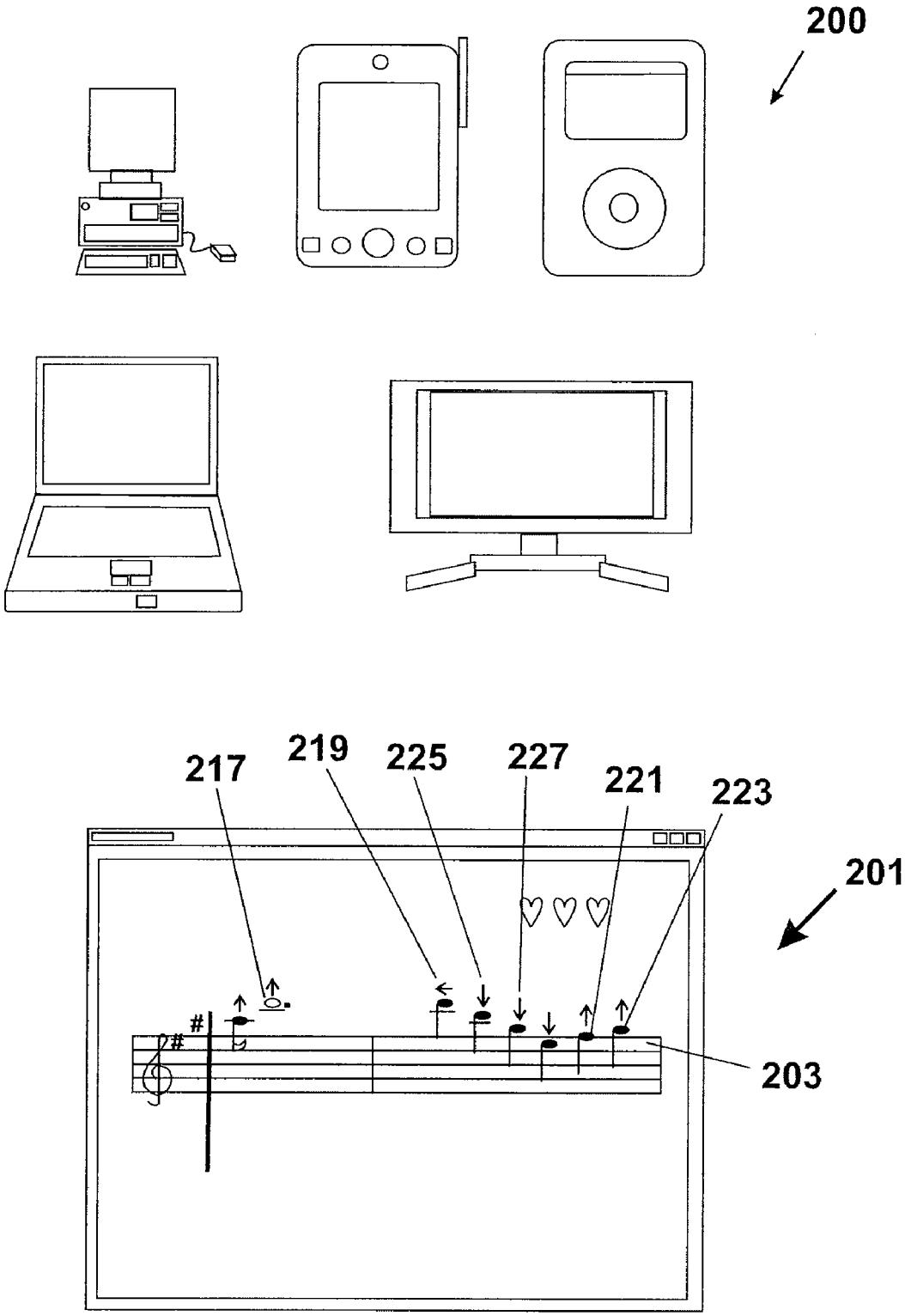
FIGS. 2 and 2A are simplified diagrams of a computing device according to an embodiment of the present invention.

FIG. 2 is a simplified diagram showing an apparatus including an input device and input mechanism for processing music according to an embodiment of present invention. A computing device 200 is provided. The computing device can be selected from a personal computer, a personal digital assistant, a laptop computer, or a television display, a combination hereof or others. Of course the apparatus used depends on the user and the application. As shown in FIG. 2, the apparatus includes a display device 201. The display device is adapted to output a sequence of notes 1 through N 203 from a selected piece of music composition.

Figure 2A:
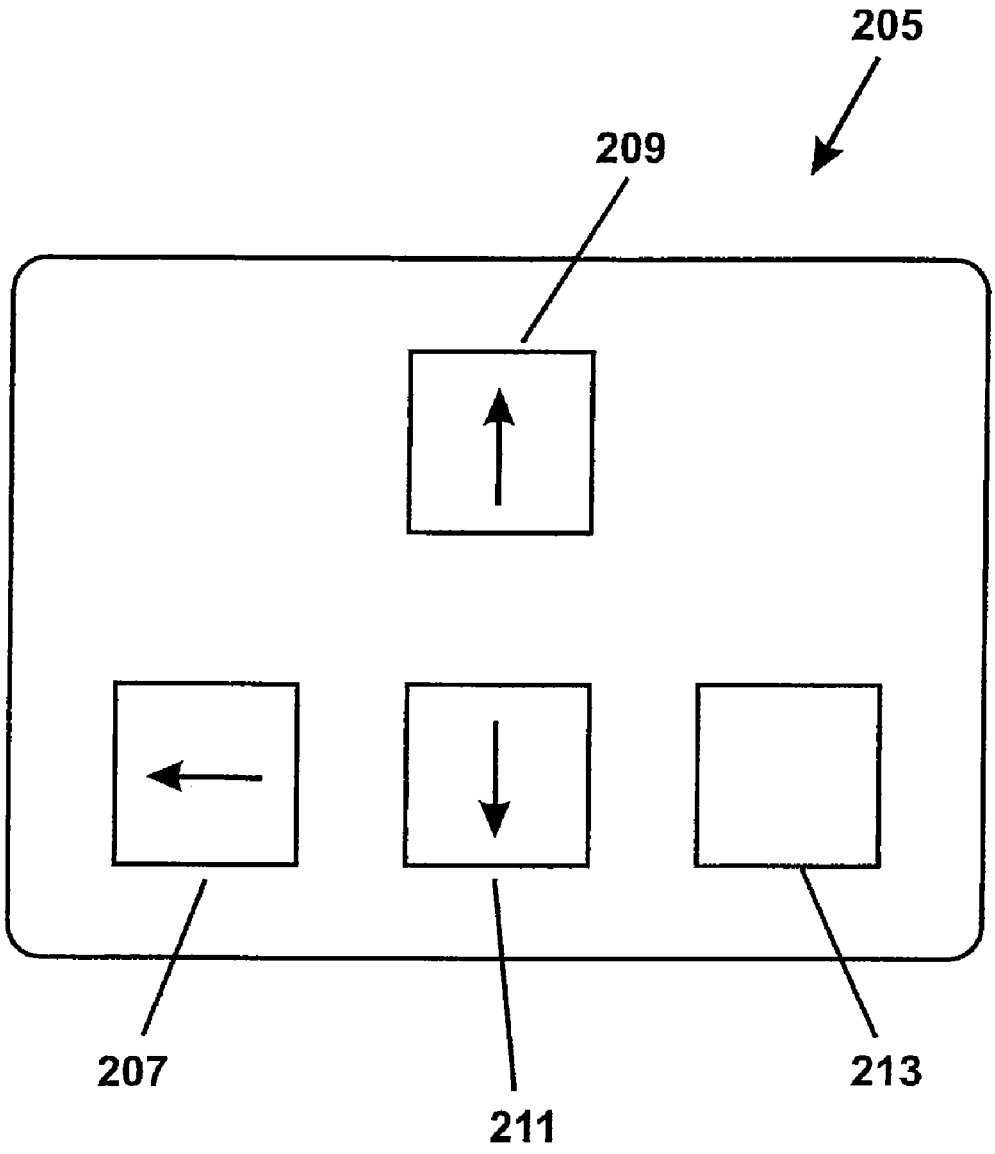

Also included in the apparatus is an input device 205 and an associated input mechanism as shown in FIG. 2A. The input device includes at least a first key 207, a second key 209, a third key 211, and a fourth key 213. The input device can be provided on a keyboard or a keypad of a personal computer, a personal digital assistant, a cellular phone, a laptop computer, or a game controller, and the like As shown, the first key is actuated to represent a same pitch from a first note 217 to a second note 219 in the sequence of notes. The first note is temporally before the second note and the first note is spatially adjacent to the second note. Second key 209 is actuated to represent a higher pitch from a third note 221 to a fourth note 223 in the sequence of notes. The third note is temporally before the fourth note and the third note is spatially adjacent to the fourth note. Third key 211 is actuated to represent a lower pitch from a fifth note 225 to a sixth note 227 in the sequence of notes. The fifth note is temporally before the sixth note and the fifth note is spatially adjacent to the sixth note.

Input device 205 may also include a fourth key 213. The fourth key may be selected interchangeably with the first key, or the second key, or the third key. For example, the fourth key may be selected interchangeably with the first key, or the second key, or the third key in a legato style. Of course, one skilled in the art would recognize many other variations, modifications, and alternatives.

Figure 3:
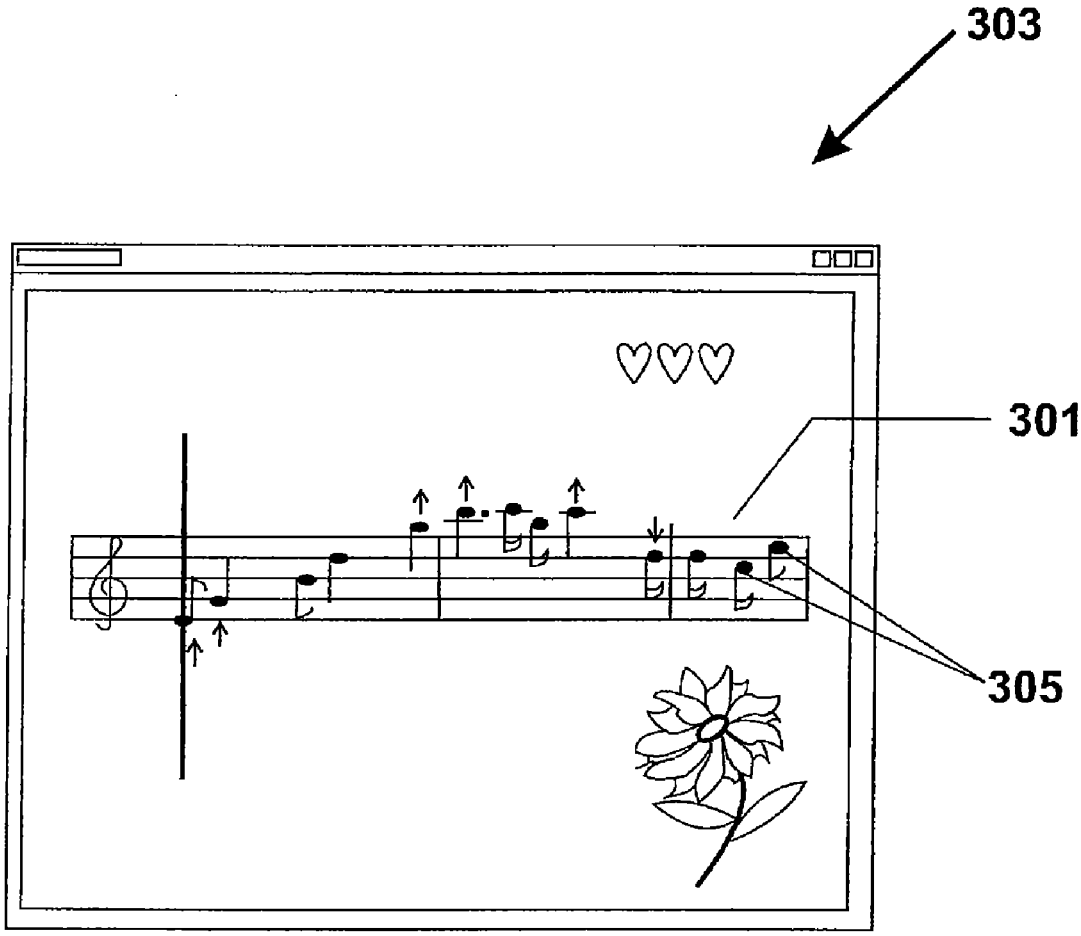
FIG. 3 illustrates a method for processing music parts according to an embodiment of the present invention.

In a specific embodiment, the present invention provides a method for processing music. As shown in FIG. 3, a music composition 301 is provided on a display device 303. Musical composition 301 includes a sequence of notes 305, which can be a selected part of a music composition. The music composition may be a known piece of music composition or others. The method includes animating the notes on the display device in the order of the sequence of notes. The method includes receiving an input from a user during a selected time as the notes are being animated on the display device. The computer device processes the input information from the user and output a sound. The sound is associated with the notes in the selected part of the music composition. Additionally, the sound is associated with characteristics such as a pre-assigned pitch, a pre-assigned sound timber, and pre-assigned volume, among others. In a specific embodiment, the animated notes are displayed concurrently with one or more background images. The one or more background images can be one or more still images. The one or more background images can also be provided from a video source. As merely an example, flowers such as daisy are displayed as background as shown in FIG. 3. Of course, there can be other modifications, variations, and alternatives.

Figure 4:
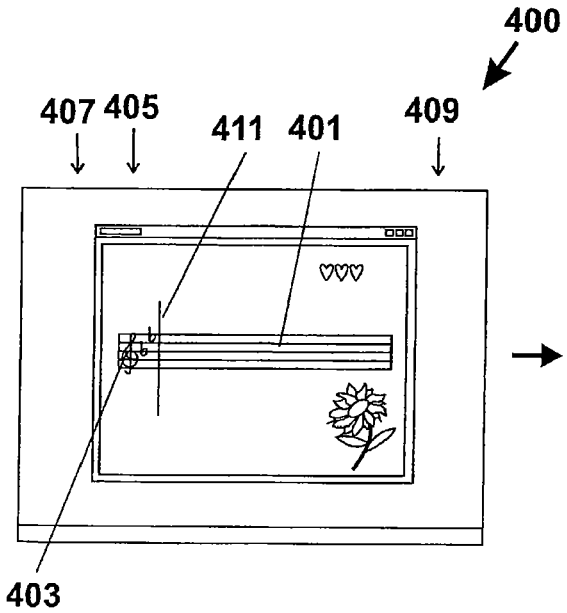
FIG. 4 through 7 illustrate a method for processing music parts according to an embodiment of the present invention.

FIG. 4-7 illustrate a method for processing and music according to an embodiment of the present invention. As shown, music staff 401 and clef 403 are provided on a display device 400. The music staff and the clef are spatially stationary on the display. Additionally, a reference region 405 is also provided in between a left portion 407 of the display and a right portion 409 of the display. A vertical visible reference line 411 is disposed in the reference region normal to the provided music staff as shown in FIG. 4

Figure 5:
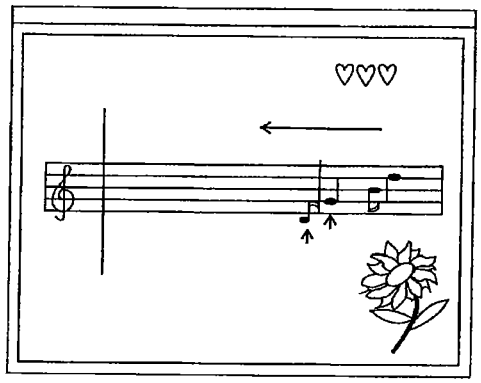
Figure 6:
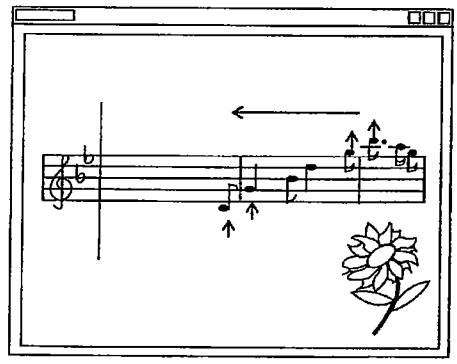
Figure 7:
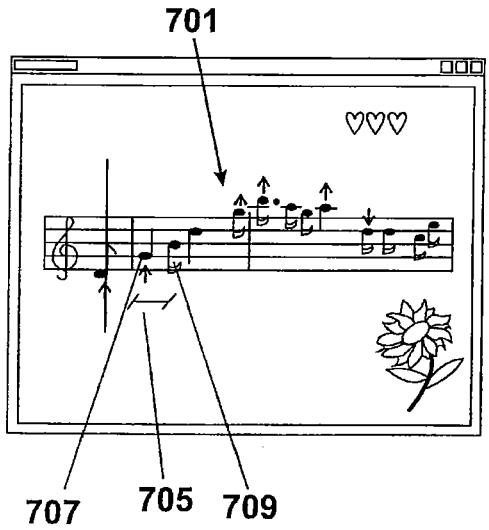

As shown in FIG. 5-7, a sequence of notes 501 are animated and scrolled on the music staff in the order of a selected music composition. In a specific embodiment, the sequence of notes are animated by scrolling from the right portion of the display device to the reference region as shown in FIGS. 4, 5, 6, and 7. The sequence of notes may include a selected part of a music composition. Such selected part of the music composition may be a single voice portion of the music composition, or a bass portion of the music composition, or any discrete portion of the music composition. The animation and scrolling of the sequence of notes are provided at a constant velocity.

In a specific embodiment, the method also includes receiving an input using input device in FIG. 2A from a user during a selected time as the sequence of notes are being animated and scrolled on the display. A computing device processes the input and outputs a sound. The selected time can be, for example, when a selected note in the sequence of notes passes the vertical reference in the reference region. Of course there can be other variation, modification, and alternatives.

The method for processing music compositions according to an embodiment of present invention also includes displaying a selected part of music composition 700 on a display screen as illustrated in FIG. 7. The selected music composition includes multiple notes 701 displayed on musical staff. As shown, each of the multiple notes are spatially separated by a distance 705. Distance 705 is a time characteristic between a first music note 707 and a second music note 709 displayed. Depending on the embodiment, the selected part of music composition can be a melody portion of the music composition, a single voice portion of the music composition, a bass portion of the music composition, or any discrete part of the music composition. Of course there can be other variation, modification, and alternatives.

Figure 8:
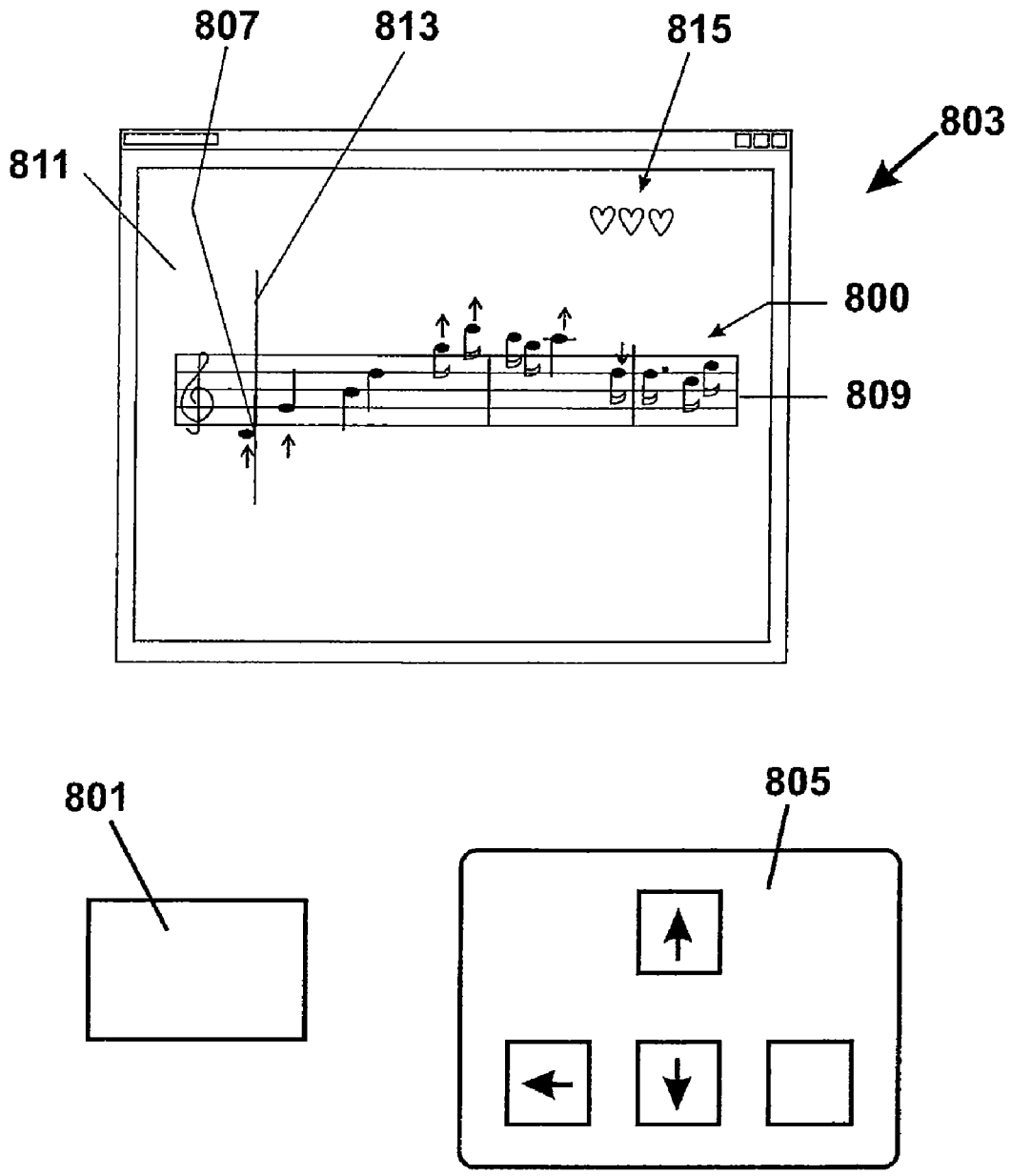
FIG. 8 is a simplified diagram illustrating a method of processing music parts according to an embodiment of the present invention.

In a preferred embodiment, the present invention provides a method for playing a music piece. The music piece can be a selected part of a music composition 800 as shown in FIG. 8. A computing device 801 is provided. The computing device can be selected from a personal computer, a personal digital assistant, a laptop computer, or a television display but can be others. The method includes transferring the selected part of the music composition in digital form to a display device 803 as shown in FIG. 8. The method also provides a plurality of input keys 805. In a specific embodiment, the plurality of input keys includes four keys. In a alternative embodiment, the plurality of input keys includes three keys. Of course the number of keys depends on the application. The music composition is represented in a sequence of notes 807 on music staff 809 on the display device. The music staff is provided in a spatially fixed location on the display in some embodiments but can be others. The method scrolls the sequence of musical notes on musical staff in an order of the musical composition and displays on the display device. For example, the sequence of musical notes can be scrolled from a right side of the display device to a left side, towards a reference region 811 of the display device at a constant velocity in a specific embodiment. A reference line 813 normal to the music staff is disposed in the reference region. The sequence of notes is displayed on the display device as an apparatus assignment and has a first character. The first character is associated with a first color scheme such as a monochrome, for example. At a first time interval, a human user provides an input or a user assignment using one or more of the plurality of input keys to play one or more notes as the sequence of musical notes is scrolled on the display. The user input note has a second character. The second character can be a second color, or blinking notes, or a combination. The method processes the input from the human user and output a sound. The sound is associated with one or more notes in the selected part of the music composition. The method continues with the steps of providing input from the human user, processing the input, and outputting the sound to play the music composition. Of course, there can be other variations, modifications, and alternatives.

As shown in FIG. 8, the method also provides a score system 815. The method outputs a score indicator to determine a timing accuracy of the input provided by the human user. The time accuracy can be measured by, for example, the proximity of a user input note to the reference line. A higher score may be awarded the closer the left side of a user input note is to the reference line. Of course there can be other modifications, variations, and alternatives.

Figure 9:
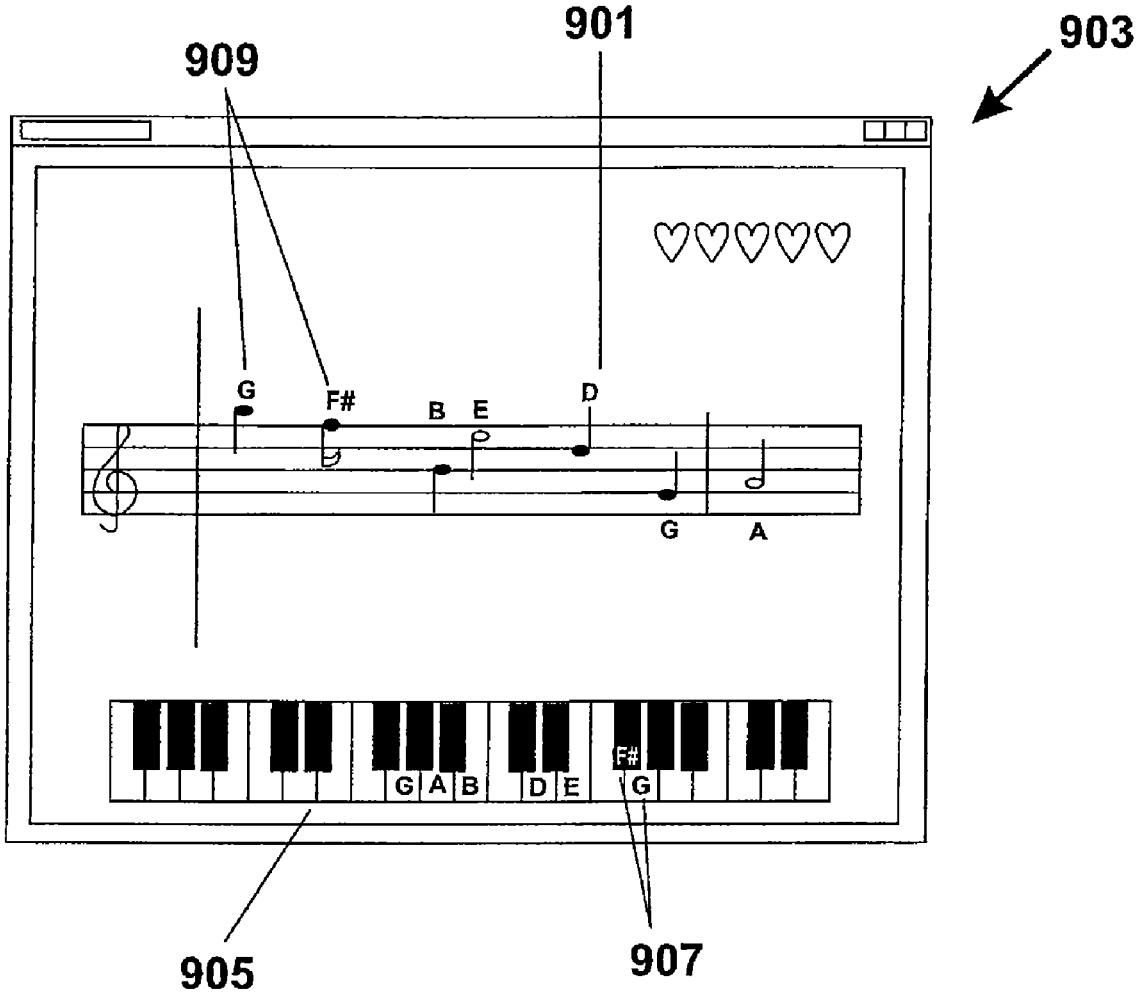
FIG. 9 is a simplified diagram illustrating an alternative method for playing music parts according to an embodiment of the present invention.

In a specific alternative embodiment, the method for playing music compositions is provided. As shown in FIG. 9, a selected music composition 901 is provided. The selected music composition is provided in a digital form and displayed as a sequence of notes on a display device 903. The selected music can be part of a published musical composition, but can be others. The method further provides a portion of a piano keyboard 905 on a portion of the display. One or more letter notes indication 907 associated with at least the sequence of notes are provided on the piano keyboard. As shown, letter notes G, A, B D, E, $F^{\#}$, and A are provided on the piano keyboard. Corresponding letter notes 909 are provided on the sequence of notes of the selected music composition. Of course there can be other modifications, variations, and alternatives, for example, the letter notes can be displayed on other musical instrument, among others.

In a specific embodiment, the present invention provides a system for processing music compositions. The system includes one or more memories, the one or more memories include at least the following:

1. One or more codes directed to receiving a selection of a music composition in digital form. The one or more memories can also include one or more codes directed to transferring information representing a sequence of notes to a display device of a computing device. The sequence of notes represents a selected part of the music composition.

2. One or more codes directed to scrolling the sequence of notes on the display device. The system also includes one or more codes directed to receiving input information from an input from a human user during a selected time as one or more notes are being scrolled in the sequential order of the music composition on the display device.

3. One or more codes directed to processing the input by the computing device from the human user.

4. One or more codes directed to outputting a sound associated with the one or more notes based upon at least the processing. The sound is associated with the one or more notes in the selected part of the music composition.

Although a number of specific embodiments are shown and described above, embodiments of the invention are not limited thereto. For example, a piano keyboard is demonstrated. Other musical instruments, for example, other string instrument such as a violin may also be used in the display. The instrument used in the display depend on user's preference and application. Of course one skilled in the art would recognize many other variations, modifications, and alternatives.

It is also understood that the examples and embodiments described herein are for illustrative purposes only and that various modifications or changes in light thereof will be suggested to persons skilled in the art and are to be included within the spirit and purview of this application and scope of the appended claims

What is claimed is:

1. A music composition input device, the device comprising:

a display device, the display device being adapted to output a sequence of notes numbered from 1 through N, where the sequence of notes is scrolled from a first portion of the display to a second portion of the display;

a first key being selectively actuated to represent a same pitch from a first note to a second note in the sequence of notes, the first note being temporally before the second note and the first note being adjacent to the second note;

a second key being selectively actuated to represent a change to higher pitch from a third note to a fourth note in the sequence of notes, the third note being temporally before the fourth note and the third note being adjacent to the fourth note; and a third key being selectively actuated to represent a change to lower pitch from a fifth note to a sixth note in the sequence of notes, the fifth note being temporally before the sixth note and the fifth note being adjacent to the sixth note.

2. The device of claim 1 wherein the first key, the second key, and the third key are provided on a computer keyboard.

3. The device of claim 1 wherein the first key, the second key, and the third key are provided on a personal digital assistant keyboard or cellular phone keyboard.

4. The device of claim 1 wherein the first key, the second key, and the third key are provided on a game controller keyboard.

5. The device of claim 1 further comprising a reference region provided on the display output, the reference region being between the first portion and the second portion of the display.

6. The device of claim 1 further comprising a fourth key being selected to be interchanged with any of the first key, the second key, or the third key.

7. The device of claim 1 wherein the sequence of notes is derived from a part of a music composition in digital form.

8. The device of claim 1 further comprising a fourth key being selected to be interchanged with any of the first key, the second key, or the third key in a legato style.

* * * * *